United States Patent [19]

Walk et al.

[11] Patent Number: 4,813,103

[45] Date of Patent: Mar. 21, 1989

[54] DEVICE FOR THE REMOVAL OF FIBER MATERIAL BY SUCTION

[75] Inventors: Johann Walk, Eichstaett; Rudolf Reeber, Iggensbach, both of Fed. Rep. of Germany

[73] Assignee: Schubert & Salzer Maschinenfabrik Aktiengesellschaft, Ingolstadt, Fed. Rep. of Germany

[21] Appl. No.: 115,708

[22] Filed: Nov. 2, 1987

[30] Foreign Application Priority Data

Nov. 4, 1986 [DE] Fed. Rep. of Germany ..... 3637580

[51] Int. Cl.[4] ..... D01G 7/10

[52] U.S. Cl. ..... 19/80 R; 19/81

[58] Field of Search ..... 19/80 R, 81

[56] References Cited

U.S. PATENT DOCUMENTS 4,475,269 10/1984 Goldammer ..... 19/80 R

*Primary Examiner*—Louis K. Rimrodt

*Attorney, Agent, or Firm*—Dority & Manning

[57] ABSTRACT

Apparatus for the removal by suction of fiber material on a movable bale opener which includes a suction channel with a fixed connection opening and a movable connection opening. The movable connection opening is part of a longitudinal slit in the suction channel, capable of being sealed by means of a covering band.

In a space-saving arrangement which does not hinder the laying down of bales and makes it possible to remove the fiber material by suction in a pneumatically advantageous manner, the suction channel 3 is located in a plane above the bales B and the covering band 4, attached to the two ends of the longitudinal slit, 31 is held in sealing position by magnetic force.

12 Claims, 3 Drawing Sheets

DEVICE FOR THE REMOVAL OF FIBER MATERIAL BY SUCTION

SUMMARY OF THE INVENTION

The instant invention relates to a device for the removal of fiber material by suction on a bale opener, with a suction channel and with a fixed connection opening and a movable connection opening, whereby the movable connection opening is part of a longitudinal slit in the suction channel, which is capable of being sealed by means of a covering band.

The use of a suction channel installed next to the path of travel of the bale opener to remove fiber material taken from fiber bales is known in German Pat. No. 3,206,257. The suction channel is provided with a fixed connection opening to connect a pneumatic conveying device to the suction side and with a movable connection opening for the introduction of the fiber material into the suction channel. The movable connection opening, into which a conduit coming from the area of fiber take-up ends, is part of a continuous longitudinal slit in the suction channel which can be sealed by means of a flexible covering band made of spring steel. The covering band, one end of which is attached to the suction channel and the other end of which is attached to a wind-up roll capable of travelling is held in closing position by the negative pressure within the suction channel. The arrangement of the suction channel next to the travelling rails of the bale opener requires additional space and furthermore prevents any additional row of bales from being laid down on that side of the travelling track.

It has already been suggested to install the suction channel between the rails in German Pat. No. 3,334,222. Although this allows the laying down of a row of fiber bales on either side of the rails, the suction channel hinders the laying down of the fiber bales. Thus, for example, in the patented device it is not possible to lay down a row of bales along one wall, since a passage must be provided on both sides for removal of the bales. Furthermore, the removal by suction of the fiber material is effected with multiple deflection of the suction air stream, and this is unfavorable in pneumatic conveying technology.

SUMMARY OF THE INVENTION

It is the object of the instant invention to create a device, which makes it possible to remove the fiber material by suction in a space-saving manner, and which does not hinder the laying down of bales and is pneumatically advantageous.

This object is attained by the invention in that the suction channel is located in a plane above the bales and in that a covering band, attached at the two ends of the longitudinal slit, is held in sealing position by a magnetic force.

This makes it possible to use the floor surface as desired for the conveying and the laying down of bales and allows the suction channel to remain extensively free of extraneous influences. Furthermore, the possibility is created of sucking away the fiber material taken out vertically up to the bale surface, whereby the magnetic seal holds the covering band securely in a covering position in any position, even when no negative pressure is present, no matter in which longitudinal side of the suction channel the longitudinal slit is made.

The longitudinal slit is preferably made on the underside of the suction channel. A sufficiently wide contacting surface for the covering band against the suction channel is created by means of flanges which are covered with magnetic bands on their side closest to the covering band. In a further embodiment of the invention, the flanges are at the same time used as running surfaces for a slide which is provided with deflection rolls for the covering band and is suspended from the flanges. A U-shaped excursion of the covering band is here effected through the fact that the deflection pulleys are supported in pairs and at a distance from each other in the slide.

In order to completely suck away the fiber material from the area in which it is taken from the bales, and in order to convey it into the suction channel, two movable connection openings which face each other are installed between the deflection roller pairs, and a conduit ends into each of these openings. Provisions can further be made for the movable connection openings to be offset with respect to each other.

In a further embodiment of the invention, a box-like insert containing the movable connection opening is provided in the slide, the insert being open in the direction of the slit. The insert preferably reaches into the suction channel. Provisions can be made here for sealing strips to be attached to the sidewalls of the insert extending in the longitudinal direction of the suction channel, said sealing strips being pressed against the inner wall of the suction channel. In a preferred further embodiment of the device, a cover installed on the insert seals the suction channel on the side furthest from the fixed connection opening. Closure is perfected by the fact that a seal is attached to the circumference of the cover.

Improvement of air guidance into the suction channel is achieved by providing an air guiding plate which reaches into the suction channel and extends in the direction of removal by suction. In order to avoid entry of extraneous air currents into the suction channel, the slide is enclosed in a housing which is pressed against the suction channel by sealing strips. The sealing strips consist preferably of closely adjoining bristles. The movement of the slide along the suction channel is carried out by the travelling bale opener, whereby the slide is coupled via fork-like carriers to the machine frame of the bale opener.

DETAILED DESCRIPTION OF THE DRAWINGS

Figure 1:
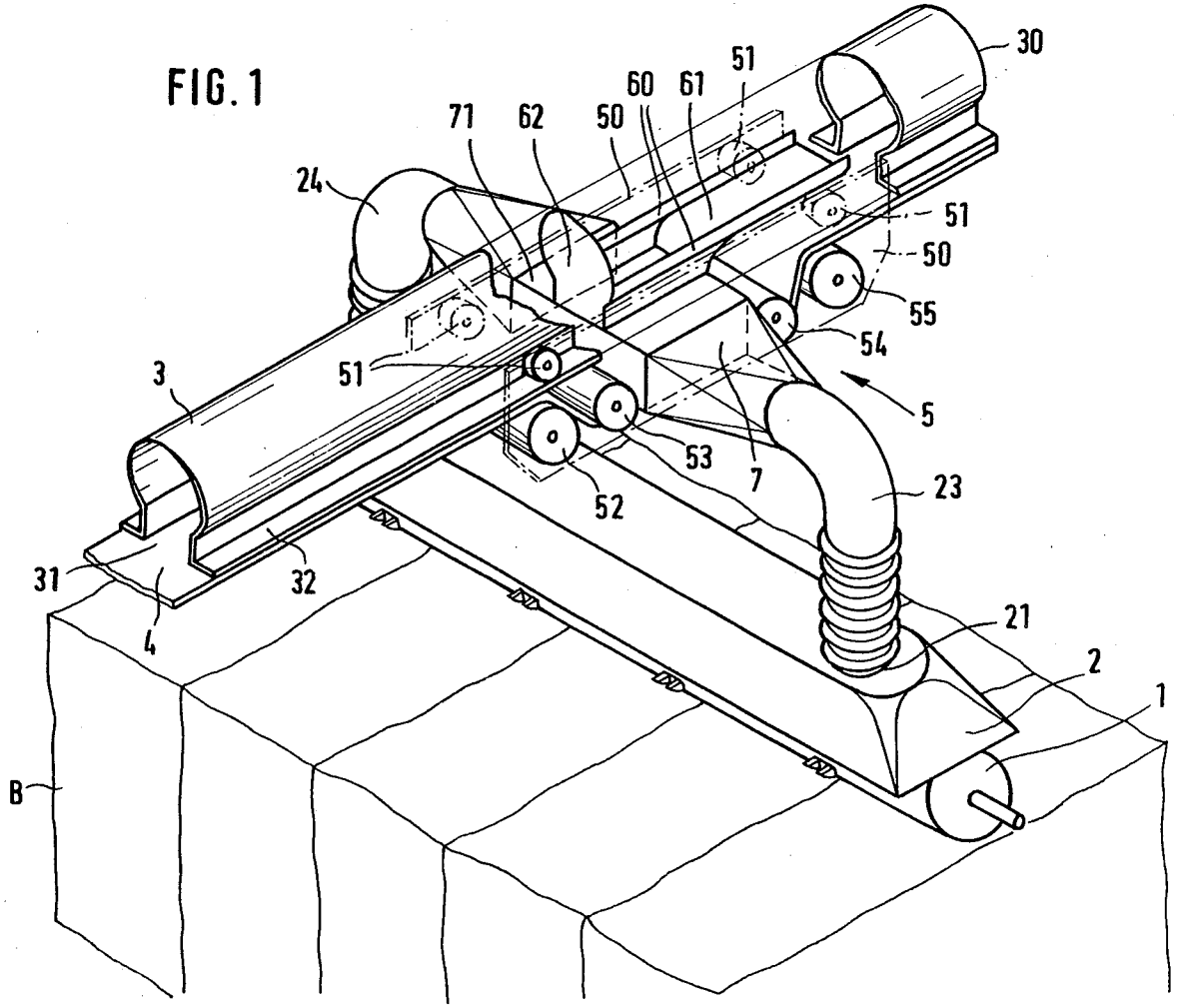
FIG. 1 is a perspective drawing of the fiber-removing roll of a bale opener with its suction removal device.

FIG. 1 shows a fiber-removing roll 1 of a bale opener capable of travelling alongside a row of fiber bales B, said fiber-removing roll 1 is being fitted with needles or teeth. The fiber-removing roll 1 is covered by a suction hood 2 which is provided with at least two suction openings. In the embodiment shown, as an example, there are two suction openings 21 which are connected respectively by conduits 23 and 24 to a suction channel 3, as shall be described hereinafter in greater detail. The second suction opening is not shown in FIG. 1. The arrangement of two suction openings 21 at a distance from each other, each near one end of the fiber-removing roll 1 is especially practical when two or more fiber bales B lying side by side are to be opened simultaneously and when the fiber-removing roll 1 is of appropriate length for this. The fiber-removing roll 1, together with the suction hood 2, (which is now shown in detail) is capable of being displaced in a vertical direction. To enable the conduits 23 and 24 to follow the vertical movement, they are fashioned, at least in part, in the form of extensible bellows.

The suction channel 3 is located in a plane above the fiber-removing roll 1, preferably close its center and above it. However, it can also be installed laterally with respect to the fiber-removing roll 1 if necessary.

The suction channel 3 has a tube-shaped cross-section, whereby the open side, forming a longitudinal slit 31, is facing the fiber-removing roll 1. Other embodiments of the suction channel and arrangement of the longitudinal slit are, however, not excluded by this. The suction channel 3 is provided with a fixed connection opening 30 at its one end, through which it is connected to the suction side of a pneumatic conveyor (not shown).

The longitudinal slit 31 on the underside of the suction channel 3 is covered by a covering band 4 which is made of spring steel and is attached at each end of the longitudinal slit 31 to the suction channel 3 by a screw (not shown). The suction channel 3 is provided with flanges 32, directed to the outside, against which the covering band 4 is applied. The flanges 32 are covered by magnetic bands 33 (FIG. 2) at either side facing the covering band 4, so that the covering band 4 is held by magnetic force in closing position against these contact surfaces.

The upper side of flange 32 serves as a running surface for the wheels 51 of a slide 5 which is suspended from the suction channel 3 by means of wheels 51. In the sidewalls 50, parallel to the suction channel 3, of slide 5, two pairs of deflection pulleys 52, 53, 54 and 55 are supported and serve to lift the covering band 4 from the longitudinal slit 31 and to shift it away. The deflection pulley pairs 52, 53, 54 and 55 are located at a distance from each other, whereby the covering band 4 runs between each pair of deflection pulleys so that its course follows a U-shaped excursion away from the longitudinal slit 31.

In the area between the two deflection pulley pairs 52, 53, 54 and 55, openings are provided in the sidewalls 50 of slide 5 which face each other. These, together with the corresponding openings in a box-shaped insert 6 installed in slide 5, constitute the movable connection openings 7 and 71 into which the conduits 23 and 24 end. The insert 6 is completely open to the top, in the direction of the longitudinal slit 31. To avoid that the two streams of fiber flakes impact against each other as they emerge from the conduits 23 and 24, the connection openings 7 and 71 are offset with respect to each other. In another, a stream-friendly arrangement, the conduits 23 and 24 end in the direction of suction into the movable connection openings 7 and 71.

Figure 3:
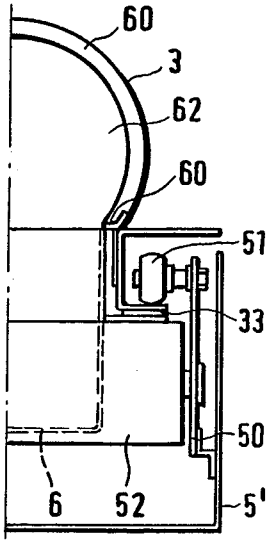
FIG. 3 is a front view of the device according to FIG. 2.

The box-shaped insert 6 preferably extends into the suction channel 3, whereby elastic sealing strips 60 or sealing lips are attached to the sidewalls extending in the longitudinal direction of the suction channel 3. The sealing strips 60 are in contact with the inner wall of the suction channel 3 (FIG. 3). A cover 62 closes the suction channel 3 on the side across from the fixed connection opening 30. The cover 62 is attached to insert 6 or is integrated into the latter, and is thus capable of travelling together with slide 5. In order to ensure that suction channel 3 is completely sealed by cover 62, said cover 62 is provided with a seal 60 on its circumference. The preferably elastic seal 60 slides along the inner wall of suction channel 3 when the slide 5 is shifted, and thereby exerts a simultaneous cleaning action.

Figure 2:
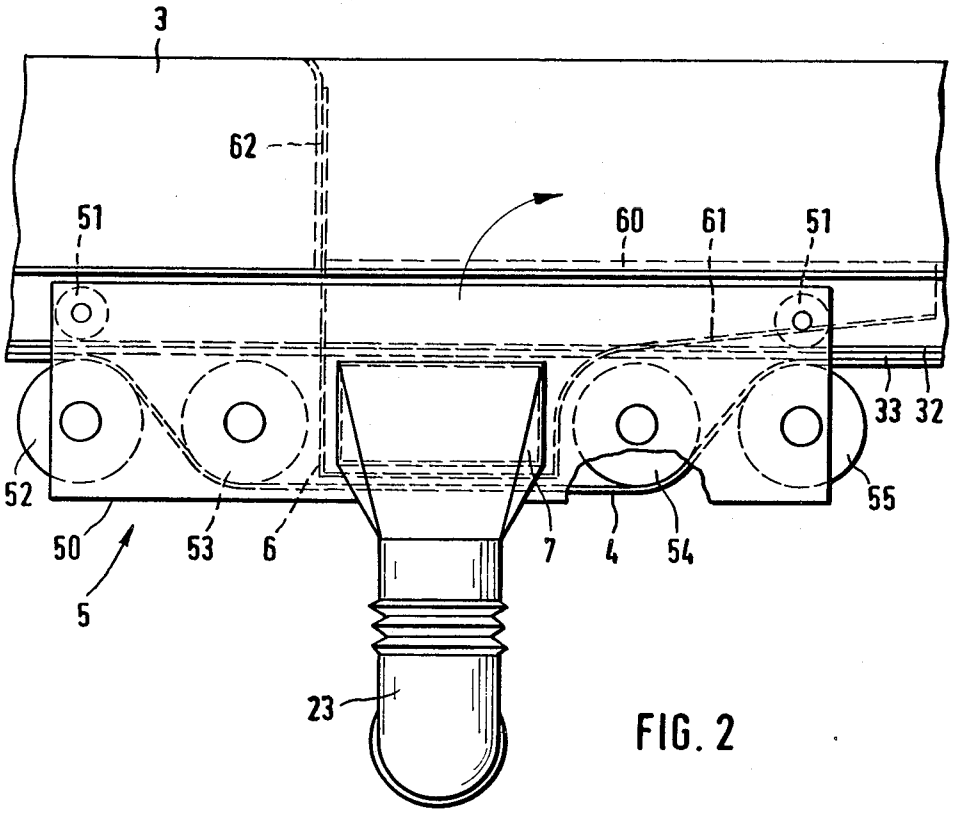
FIG. 2 is a side view of a slide suspended from the suction channel according to FIG. 1.

Attached to insert 6 or integrated into it is furthermore an air guiding plate 61 which assists the guidance of the stream of fiber-charged air into the suction channel (FIGS. 1 and 2). This air guidance plate 61, reaching into the suction channel 3, extends in the direction of suction over the two deflection pulleys 54 and 55 and covers the longitudinal slit 31 which lies open between them.

Figure 5:
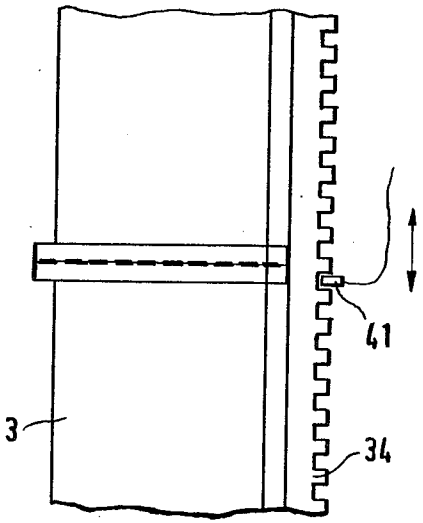
FIG. 5 is a top view of a notched flange of the suction channel.
Figure 4:
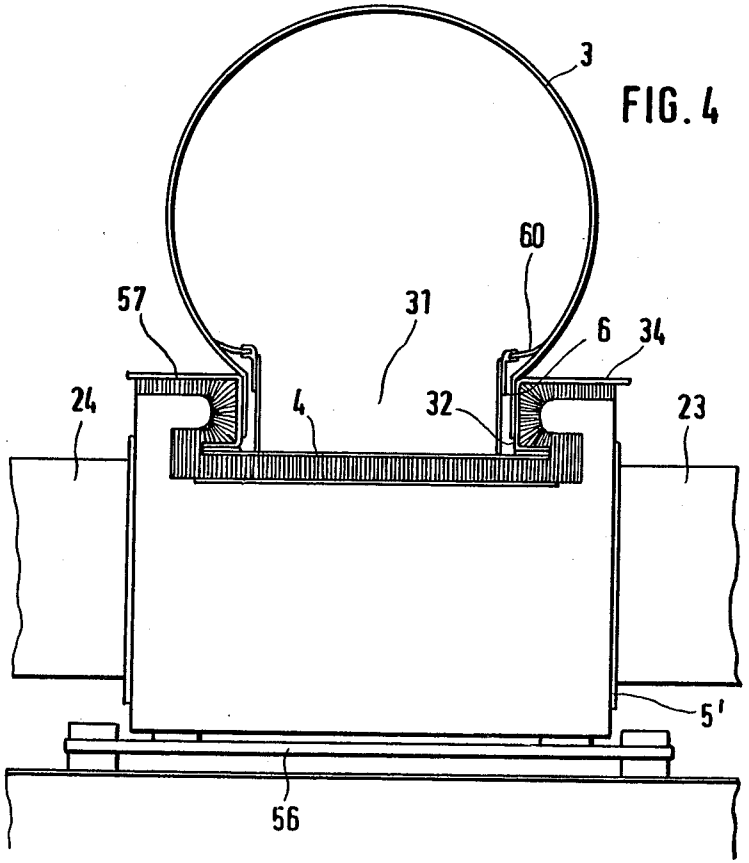
FIG. 4 is a cross-section of the suction channel.

To screen the slide against the atmosphere and to avoid extraneous air currents, slide 5 and its insert 6 are completely enclosed in a housing 5 which is fixedly attached to the sidewalls 50 of slide 5 (FIG. 3). As shown in FIGS. 4, housing 5 is fitted all around with sealing strips 57 on the open side closest to suction channel 3, said sealing strips 57 consisting preferably of elastic bristles arranged close to each other and adhering to the covering band 4 as well as to the flanges 32 and flanges 34. The flanges 34 can be used for the installation of a pulse counter 41 (FIG. 5) serving to determine the travelling path of the bale opener. The pulses are produced by notches which are provided at equal distances from each other on flange 34.

Slide 5, enclosed by housing 5, is driven by means of fork-like carriers 56 (FIG. 4) through which slide 5 or its housing 5 is coupled to the machine frame of the bale opener.

What is claimed is:

1. A device for the removal of opened fiber from a movable bale opener by suction means, comprising:

(a) a fixed suction channel having a fixed opening connecting said channel to a source of suction, and a longitudinal slit extending along one wall of said channel, said wall being located in a plane above the bales of fiber; and (b) a movable conduit, one end of which is connected to said bale opener, and movable therewith, and the other end of which is connected to said suction channel by a movable connection with includes a flexible steel band for covering said longitudinal slit between said movable connection and said fixed opening, said band being held in said covering position by magnetic force.

2. A device as set forth in claim 1, wherein said longitudinal slit is located on the underside of said suction channel.

3. A device as set forth in claim 1, wherein said suction channel comprises flanges which are covered with magnetic bands on the side of said channel closest to said covering band.

4. A device as set forth in claim 3, wherein said movable connection comprises deflection pulleys for said covering band and said pulleys are suspended from said flanges.

5. A device as set forth in claim 4, wherein said deflection pulleys are supported in a slide in pairs disposed at a distance from each other.

6. A device as set forth in claim 5, wherein two movable connection openings are located opposite each other between the deflection pulley pairs, into each of which an end of said movable conduit ends.

7. A device for the removal of opened fiber from a movable bale opener by suction means, comprising:

(a) fixed channel having one end fixed to a source of suction, and a longitudinal slit which extends along the underside of said channel, said channel being located in a plane above the bales of fiber being opened by said opener;

(b) a pair of movable conduits, each of which has one end connected to said bale opener;

(c) a movable slide disposed for movement along said fixed channel, for movement with said bale opener, said slide having an enclosed chamber which communicates pneumatically with said fixed channel through said longitudinal slit and which is pneumatically connected to the other end of said movable conduits; and (d) means for closing said longitudinal slit between said enclosed chamber and said one end of said fixed channel as said slide moves along said fixed channel.

8. A device as set forth in claim 7, wherein said means for closing said longitudinal slit comprises a flexible steel band which is held in contact with the edges of said slit by magnetic force.

9. A device as set forth in claim 8, wherein said flexible steel band is movable through said slide over a plurality of deflection pulleys.

10. A device as set forth in claim 9, wherein said reflection pulleys are supported on said movable slide in pairs spaced a distance from each other.

11. A device as set forth in claim 10, wherein said conduits are connected to said movable slide at points opposite each other and disposed between the spaced pairs of deflection pulleys.

12. A device as set forth in claim 7, wherein said movable conduits are connected to said movable slide at points opposite each other.

* * * * *